US009254546B2

(12) United States Patent
Kim et al.

(10) Patent No.: US 9,254,546 B2
(45) Date of Patent: Feb. 9, 2016

(54) CHEMICAL MECHANICAL POLISHING MACHINE AND POLISHING HEAD ASSEMBLY

(71) Applicant: Samsung Electronics Co., Ltd., Suwon-si, Gyeonggi-do (KR)

(72) Inventors: In-Kwon Kim, Hwaseong-si (KR); Kyung-Hyun Kim, Seoul (KR); Ki-Jong Park, Yongin-si (KR); Ki-Ho Bae, Seoul (KR); Jong-Heun Lim, Hwaseong-si (KR)

(73) Assignee: SAMSUNG ELECTRONICS CO., LTD., Suwon-Si, Gyeonggi-Do (KR)

( * ) Notice: Subject to any disclaimer, the term of this patent is extended or adjusted under 35 U.S.C. 154(b) by 125 days.

(21) Appl. No.: 14/045,157

(22) Filed: Oct. 3, 2013

(65) Prior Publication Data

US 2014/0235144 A1 Aug. 21, 2014

(30) Foreign Application Priority Data

Feb. 19, 2013 (KR) ..... 10-2013-0017488

(51) Int. Cl.

| | |
|---|---|
| ***B24B 37/30*** | (2012.01) |
| ***B24B 37/32*** | (2012.01) |
| ***B24B 37/10*** | (2012.01) |
| ***B24B 37/04*** | (2012.01) |

(52) U.S. Cl.

CPC ..... *B24B 37/30* (2013.01); *B24B 37/042* (2013.01); *B24B 37/10* (2013.01); *B24B 37/32* (2013.01)

(58) Field of Classification Search

CPC .... H05K 13/0069; B25B 5/006; B26D 7/015; B23Q 3/103; B23Q 16/001

USPC ..... 451/41, 285–290, 397, 398, 402, 388

See application file for complete search history.

(56) References Cited

U.S. PATENT DOCUMENTS

| | | | | |
|---|---|---|---|---|
| 5,922,779 | A * | 7/1999 | Hickey | 521/114 |
| 6,322,427 | B1 * | 11/2001 | Li et al. | 451/56 |
| 7,204,742 | B2 * | 4/2007 | Prasad | 451/41 |
| 7,364,496 | B2 | 4/2008 | Berkstresser et al. | |
| 7,815,496 | B2 | 10/2010 | Lim et al. | |
| 7,959,496 | B2 | 6/2011 | Spiegel | |
| 2007/0077866 | A1 * | 4/2007 | Choi | 451/41 |
| 2008/0188162 | A1 * | 8/2008 | Kobata et al. | 451/8 |
| 2008/0293342 | A1 * | 11/2008 | Yu et al. | 451/288 |
| 2009/0186560 | A1 | 7/2009 | Kordic | |
| 2009/0305612 | A1 * | 12/2009 | Miyazaki et al. | 451/11 |
| 2010/0173566 | A1 | 7/2010 | Paik et al. | |
| 2011/0053479 | A1 * | 3/2011 | Kim et al. | 451/548 |
| 2012/0164918 | A1 | 6/2012 | Lee et al. | |

FOREIGN PATENT DOCUMENTS

| | | |
|---|---|---|
| KR | 1020050069775 | 7/2005 |
| KR | 1020070077971 | 7/2007 |
| KR | 1020080035164 | 4/2008 |

(Continued)

*Primary Examiner* — Monica Carter
*Assistant Examiner* — Lauren Beronja
(74) *Attorney, Agent, or Firm* — F. Chau & Associates, LLC

(57) ABSTRACT

A chemical mechanical polishing machine includes a polishing head assembly including a polishing head body and a membrane disposed at a bottom of the polishing head body. The bottom surface of the membrane includes a hydrophobic area and a hydrophilic area.

20 Claims, 14 Drawing Sheets

(56) References Cited

FOREIGN PATENT DOCUMENTS

| | | |
|---|---|---|
| KR | 1020080114026 | 12/2008 |
| KR | 1020100090941 | 8/2010 |
| KR | 1020100108820 | 10/2010 |

* cited by examiner

CHEMICAL MECHANICAL POLISHING MACHINE AND POLISHING HEAD ASSEMBLY

CROSS-REFERENCE TO RELATED APPLICATION

This application claims priority under 35 U.S.C. §119 to Korean Patent Application No. 10-2013-0017488 filed on Feb. 19, 2013, the disclosure of which is hereby incorporated by reference in its entirety.

TECHNICAL FIELD

Embodiments of the inventive concept relate to a chemical mechanical polishing machine and a polishing head assembly.

DISCUSSION OF RELATED ART

To prevent a wafer from slipping during a chemical mechanical polishing process or from being damaged after the chemical mechanical polishing process, various methods, e.g., a method of adding an annexed device to a chemical mechanical polishing machine and a method of installing a fluid supply member in a chemical mechanical polishing machine, have been suggested.

SUMMARY

Exemplary embodiments of the inventive concept provide a membrane including a hydrophilic area and a hydrophobic area.

Exemplary embodiments of the inventive concept also provide a method of manufacturing a membrane including a hydrophilic area and a hydrophobic area.

Exemplary embodiments of the inventive concept also provide a polishing head assembly including a membrane with a hydrophilic area and a hydrophobic area.

Exemplary embodiments of the inventive concept also provide a chemical mechanical polishing machine including a membrane with a hydrophilic area and a hydrophobic area.

Exemplary embodiments of the inventive concept also provide a chemical mechanical polishing machine in which a wafer is prevented from slipping during a polishing process and from being damaged when the wafer is unloaded.

Exemplary embodiments of the inventive concept also provide a polishing head assembly capable of relatively easily processing and unloading a wafer using a surface tension applied to an adhesive surface between the wafer and a head assembly.

In accordance with an exemplary embodiment of the inventive concept, a chemical mechanical polishing machine may include a polishing head assembly including a polishing head body and a membrane disposed at a bottom of the polishing head body.

A bottom surface of the membrane may include a hydrophobic area and a hydrophilic area.

The membrane may include a plurality of holes.

The plurality of holes may be formed in the hydrophilic area.

The chemical mechanical polishing machine may further include a wafer loader including a support unit which is configured to support the membrane thereon.

The wafer loader may further include a second nozzle configured to supply a fluid between the membrane and the support unit.

The hydrophilic area may be located on an inner portion of the bottom surface of the membrane.

The hydrophobic area may be located on an outer portion of the bottom surface of the membrane.

The bottom surface of the membrane may further include a center region disposed in the inner portion.

The center region may be hydrophobic.

The bottom surface of the membrane may have a circular shape having a first radius. The hydrophilic area may have a circular shape having a second radius. The first radius may be about 1.1 to about 10 times the second radius.

The membrane may include silicon.

The hydrophobic area of the membrane may include hydrophobic polymer resin with a hydrocarbon radical (CH—) or a fluorocarbon radical (FC—).

The hydrocarbon radical (CH—) may include an alkyl group or a phenyl group.

The hydrophobic polymer resin may include dichloro-dimethylsilane (DDMS) or fluoro-octyl-trichloro-silane (FOTS).

The hydrophobic polymer resin may be configured to form a covalent binding with the membrane.

The hydrophobic area may have a thickness of about 1 to about 100 nm.

In accordance with an exemplary embodiment of the inventive concept, a polishing head assembly may include a polishing head body including a groove, a membrane disposed in the groove and including a plurality of holes, and a fixing ring disposed between an external side surface of the membrane and an internal side surface of the groove. A bottom surface of the membrane may include a hydrophobic area and a hydrophilic area.

The polishing head assembly may further include a plurality of gas pipes configured to be connected to the groove in the polishing head body.

The plurality of gas pipes and the plurality of holes may be connected to one another.

In accordance with an exemplary embodiment, a chemical mechanical polishing machine is provided. The chemical mechanical polishing machine includes a turntable having a substantially flat top surface and is configured to rotate horizontally, a polishing pad attached to and fixed on the top surface of the turntable, a polishing head assembly configured to move a wafer disposed on a bottom surface thereof into contact with the polishing pad and polish the wafer, a slurry supply device having at least one nozzle connected to an end portion thereof and configured to supply slurry on the polishing pad and a conditioner having a diamond disk at an end portion thereof and configured to condition a surface of the polishing pad.

The polishing head assembly includes a shaft configured to rotate as a central axis for polishing the wafer, a polishing head body disposed at a bottom surface of the shaft, in which the polishing head body includes a groove in a bottom surface thereof and a plurality of gas pipes passing through the polishing head body which are configured to be connected to the groove, and a membrane disposed in the groove. A bottom surface of the membrane includes a hydrophobic area and a hydrophilic area.

The polishing head assembly further includes a fixing ring having flexible properties and elastic properties and which is disposed between an external side surface of the membrane and an internal side surface of the groove in the polishing head body.

BRIEF DESCRIPTION OF THE DRAWINGS

Exemplary embodiments of the inventive concept can be understood in more detail from the following detail description taken in conjunction with the accompanying drawings in which.

DETAILED DESCRIPTION OF EXEMPLARY EMBODIMENTS

Figure 1:
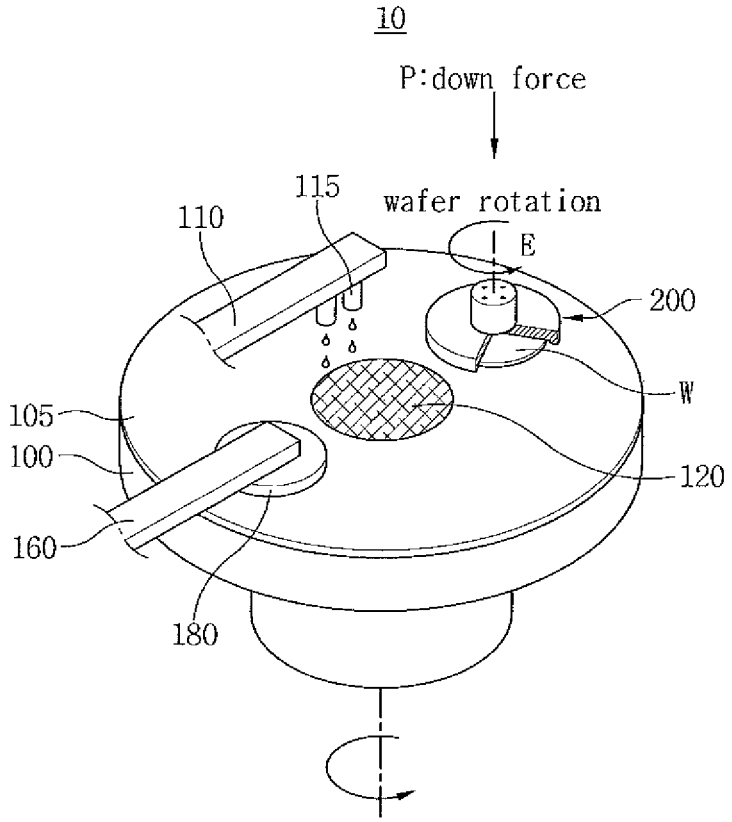
FIG. 1 is a perspective view of a chemical mechanical polishing machine in accordance with an embodiment of the inventive concept.

Exemplary embodiments of the inventive concept can be understood in more detail from the following detailed description taken in conjunction with the accompanying drawings. Exemplary embodiments of the inventive concept may, however, be embodied in many different forms and should not be construed as being limited to embodiments set forth herein. In the drawings, the thickness of layers and regions may be exaggerated for clarity. The same reference numerals represent the same elements throughout the drawings.

FIG. 1 is a perspective view of a chemical mechanical polishing machine in accordance with an embodiment of the inventive concept.

Referring to FIG. 1, the chemical mechanical polishing machine 10 may include, for example, a turntable 100, a polishing pad 105, and a polishing head assembly 200.

The turntable 100 has, for example, a flat top surface and may rotate horizontally.

The polishing pad 105 may be attached to and fixed on, for example, the top surface of the turntable 100. The polishing pad 105 may include, for example, a polyurethane foam sheet having a void volume of about 30 to about 36%. The polyurethane foam sheet has high carbonization performance and a low compression rate of, for example, about 0.5 to about 1.0%. For example, the polishing pad 105 may further include a cushion layer formed on a bottom surface of the polyurethane foam sheet. The cushion layer may support the polyurethane foam sheet to be overall evenly pressurized.

A wafer W may be mounted at the bottom of the polishing head assembly 200, and the polishing head assembly 200 may rotate, for example, in a direction of an arrow E and apply pressure on the wafer W in a direction of an arrow P to polish the wafer W. The polishing head assembly 200 will be described in more detail with reference to other drawings below.

The chemical mechanical polishing machine 10 may further include, for example, a slurry supply device 110 configured to supply slurry 120 on the polishing pad 105. At least one first nozzle 115 may be connected to, for example, an end portion of the slurry supply device 110 to face downward.

In the chemical mechanical polishing machine 10, the wafer W may be fixed, for example, at the bottom of the polishing head assembly 200 to contact a top surface of the polishing pad 105. In this case, a down-force P is applied onto the wafer W via the polishing head assembly 200, and one surface of the wafer W thus comes in contact with the polishing pad 105. The turntable 100 may rotate at a predetermined speed, and the wafer W may rotate at the predetermined speed together with the polishing head assembly 200. A predetermined amount of the slurry 120 may be supplied on the polishing pad 105 via the at least one first nozzle 115 connected to the slurry supply device 110. As polishing particles are contained in the slurry 120 supplied via the at least one first nozzle 115, a surface of the wafer W may be polished through a combination of a polishing action of the slurry 120 and a rotating movement of the wafer W.

The chemical mechanical polishing machine 10 may further include, for example, a conditioner 160 configured to condition a surface of the polishing pad 105. The conditioner 160 may include, for example, a diamond disk 180 at an end portion thereof. After chemical mechanical polishing is performed on the polishing pad 105, the polishing pad 105 may be abraded. As the conditioner 160 includes the diamond disk 180, an abraded surface of the polishing pad 105 may become rough. The diamond disk 180 may be obtained by, for example, coating diamond having a predetermined size and distribution onto a plate.

Figure 2A:
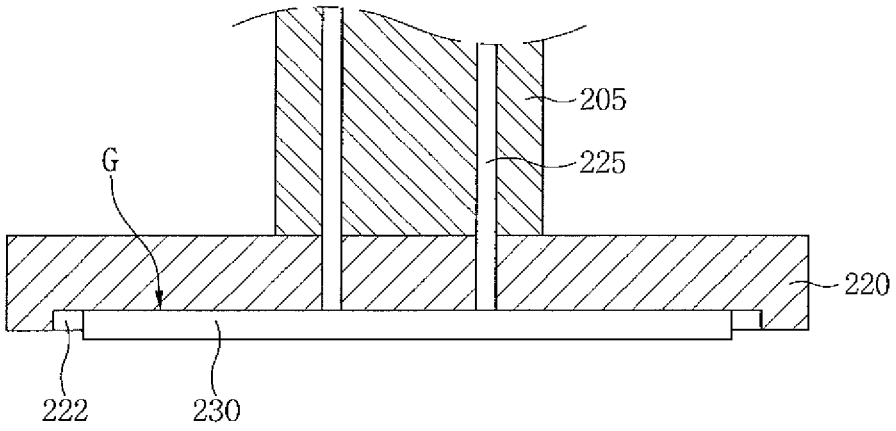
FIGS. 2A to 2C are side cross-sectional and bottom views of a polishing head assembly of a chemical mechanical polishing machine in accordance with an embodiment of the inventive concept.
Figure 2B:
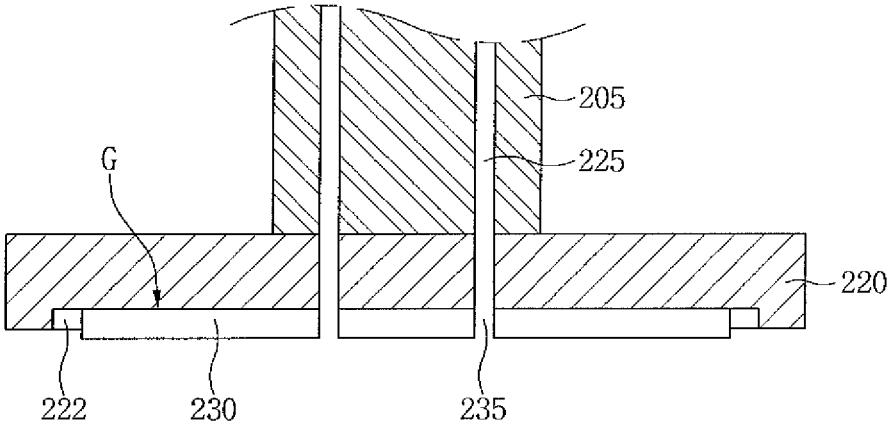
Figure 2C:
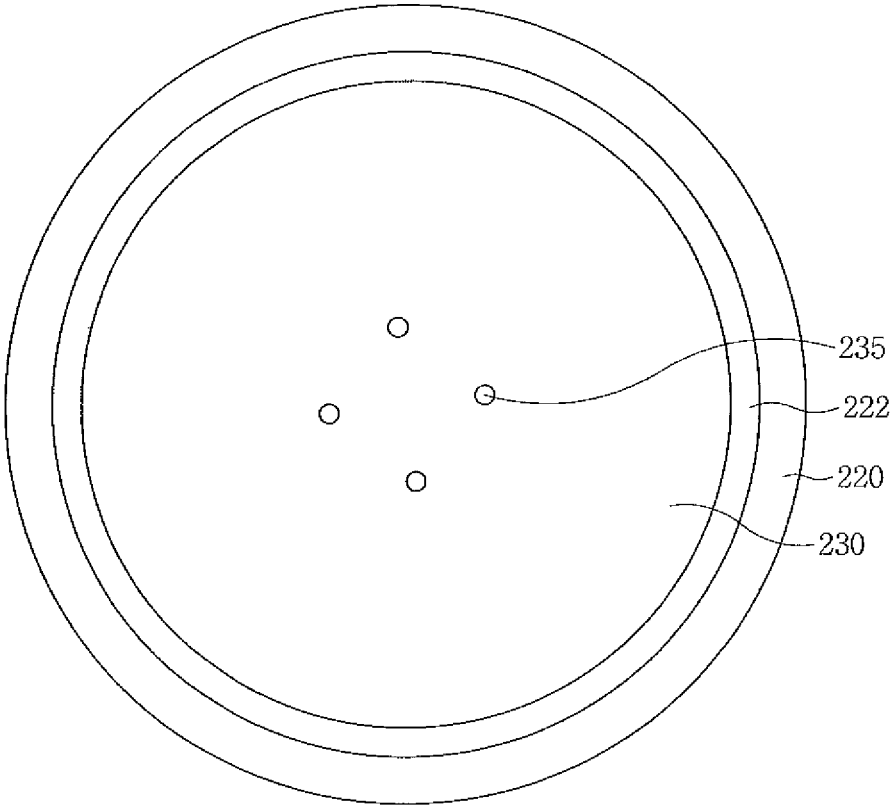

FIGS. 2A to 2C are side cross-sectional and bottom views of a polishing head assembly 200 of the chemical mechanical polishing machine 10 of FIG. 1 in accordance with an embodiment of the inventive concept.

Referring to FIGS. 2A to 2C, the polishing head assembly 200 may include, for example, a central shaft 205, a polishing head body 220 disposed at a bottom of the central shaft 205, a membrane 230 installed in a groove G formed in a bottom surface of the polishing head body 220, and a fixing ring 222 between the polishing head body 220 and the membrane 230.

The central shaft 205 may act as, for example, a rotating central axis when polishing is performed using the chemical mechanical polishing machine 10.

The polishing head body 220 may include, for example, a cylindrical or disk type shape having the groove G formed in a bottom surface thereof.

The polishing head body 220 may further include, for example, a plurality of gas pipes 225 configured to be connected to the groove G. Air may be sucked in or supplied via the plurality of gas pipes 225. Referring to FIG. 2A, the plurality of gas pipes 225 may be installed, for example, to pass through only the polishing head body 220. Referring to FIG. 2B, the plurality of gas pipes 225 may be installed, for example, to be connected to holes 235 passing through the membrane 230.

The fixing ring 222 may be disposed, for example, between an external side surface of the membrane 230 and an internal side surface of the groove G in the polishing head body 220 to cover the external side surface of the membrane 230 and the internal side surface of the groove G in the polishing head body 220. The fixing ring 222 has, for example, flexible and elastic properties, and may thus allow the membrane 230 to be in close contact with the polishing head body 220.

The membrane 230 may be inserted in the groove G. A bottom surface of the membrane 230 may, for example, protrude to be lower than a bottom surface of the polishing head body 220. The membrane 230 will be described in greater detail below.

FIGS. 3A, 4A, 5A, 6A, 7A, 8A, 9A, and 10A are schematic bottom views of membranes according to an embodiment of the inventive concept. FIGS. 3B, 4B, 5B, 6B, 7B, 8B, 9B, and 10B are side cross-sectional views taken along lines I-I', II-II', III-III', IV-IV', V-V', VI-VI', VII-VII', and VIII-VIII', respectively.

Figure 3A:
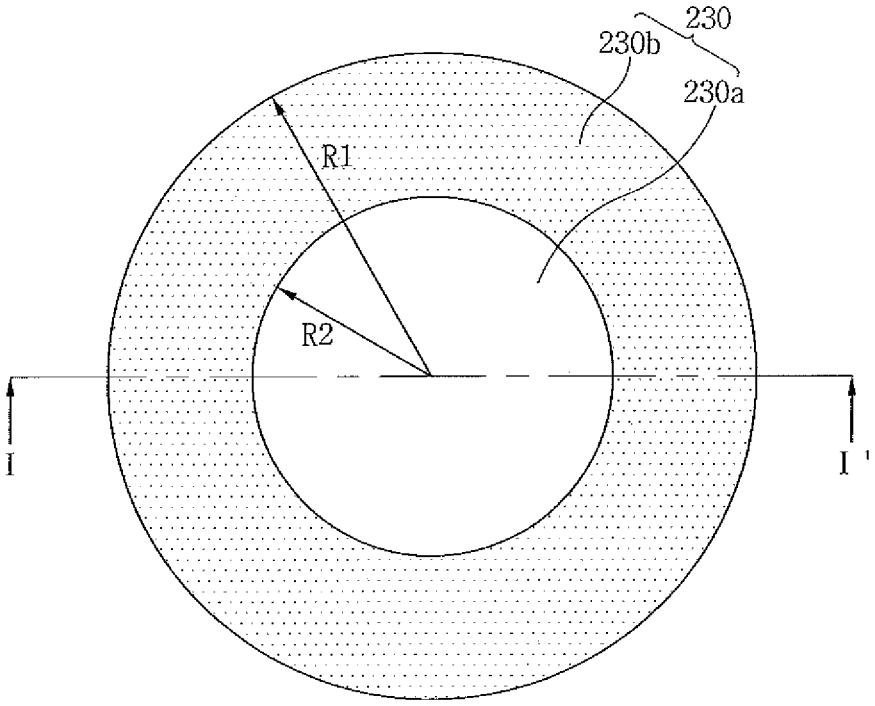
FIGS. 3A, 4A, 5A, 6A, 7A, 8A, 9A, and 10A are schematic bottom views of membranes according to an embodiment of the inventive concept.
Figure 3B:
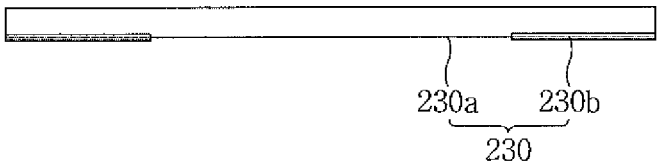
FIGS. 3B, 4B, 5B, 6B, 7B, 8B, 9B, and 10B are side cross-sectional views taken along lines I-I', II-II', III-III', IV-IV', VI-VI', VII-VII', and VIII-VIII', respectively.

Referring to FIGS. 3A and 3B, a bottom surface of the membrane 230 may include, for example, a hydrophilic area 230*a* and a hydrophobic area 230*b*. A contact angle between a surface of the hydrophobic area 230*b* and water may be, for example, greater than about 90°. The hydrophilic area 230*a* may be located, for example, on an inner portion of the bottom surface of the membrane 230, and the hydrophobic area 230*b* may be located, for example, on an outer portion of the bottom surface of the membrane 230. The hydrophobic area 230*b* may have a thickness of, for example, about 1 to about 100 nm.

The bottom surface of the membrane 230 may have, for example, a circular shape having a first radius R1, and the hydrophilic area 230*a* may have, for example, a circular shape having a second radius R2. The first radius R1 may be, for example, about 1.1 to about 10 times the second radius R2.

The hydrophilic area 230*a* has, for example, a high surface tension with respect to water and thus has a relatively high capability of adsorbing the wafer W. The hydrophobic area 230*b* has, for example, a low surface tension with respect to water and thus has a relatively low capability of adsorbing the wafer W. The capability of adsorbing the wafer W may be adjusted to be high or low, based on a ratio between the areas of the hydrophilic area 230*a* and the hydrophobic area 230*b*. When the capability of adsorbing the wafer W is high, the wafer W may be strongly adsorbed and fixed during a polishing process, thereby stabilizing the polishing process. When the capability of adsorbing the wafer W is low, the wafer W may be relatively easily desorbed during an unloading process.

The membrane 230 may include, for example, a flexible material. For example, the membrane 230 may include silicon (Si). Silicon may include, for example, OFF that is a hydrophilic radical. Thus, the hydrophilic area 230*a* of the membrane 230 may include exposed silicon.

The hydrophobic area 230*b* may include, for example, a hydrophobic polymer resin including a hydrocarbon radical (CH—) or a fluorocarbon radical (FC—). The hydrocarbon radical (CH—) may be, for example, an alkyl group (alkyl-$C_nH_{2n+1}$) or a phenyl group (—$C_6H_5$). The alkyl group (alkyl-$C_nH_{2n+1}$) may be, for example, a fluorinated organic silane precursor. The fluorinated organic silane precursor may be, for example, a silane compound including a fluoro-alkyl group of C1 to C20. For example, the silane compound may be fluoro-octyl-trichloro-silane (FOTS), trichloro(3,3,3-trifluoropropyl)silane (FPTS), perfluorodecyl-trichlorosilane (FDTS), or dichloro-dimethylsilane (DDMS).

Also, the hydrophobic area 230*b* may be, for example, a vapor self-assembled monolayer (VSAM).

Figure 4A:
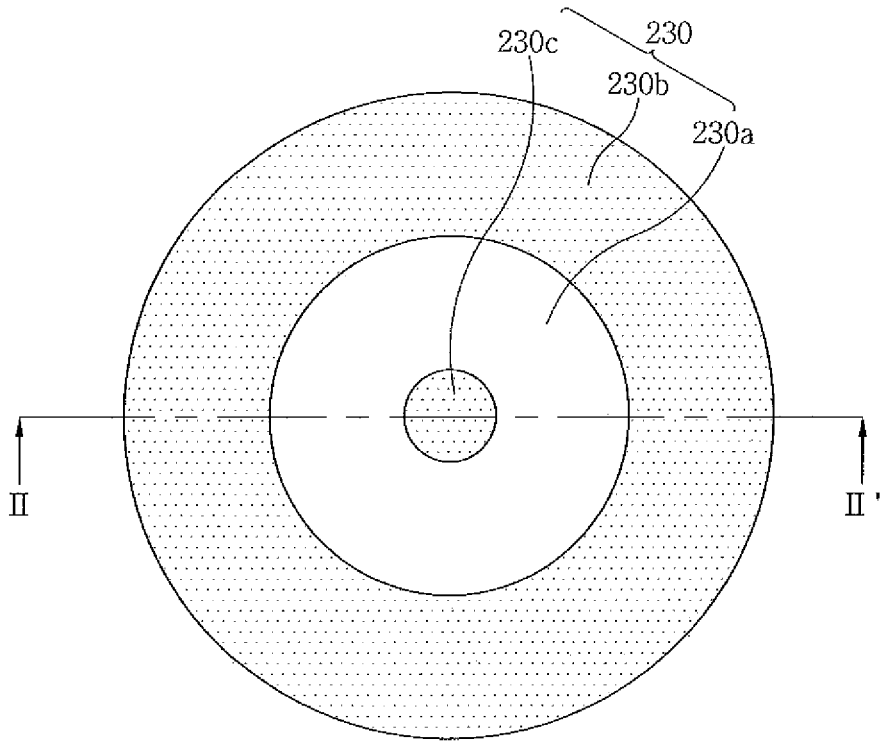
Figure 4B:
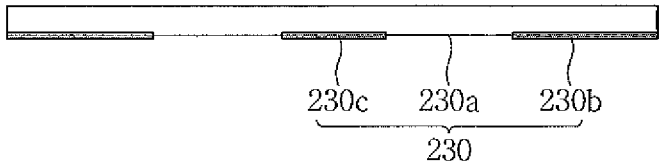

Referring to FIGS. 4A and 4B, a bottom surface of a membrane 230 may include, for example, a hydrophilic area 230*a*, a hydrophobic area 230*b*, and a center region 230*c*. The center region 230*c* may be, for example, hydrophobic.

Figure 5A:
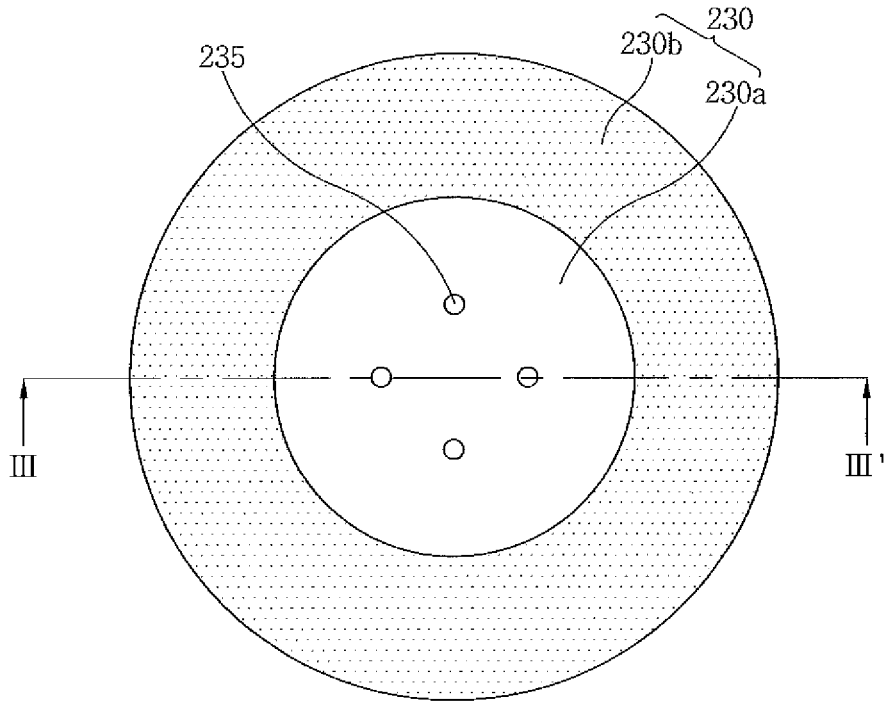
Figure 5B:
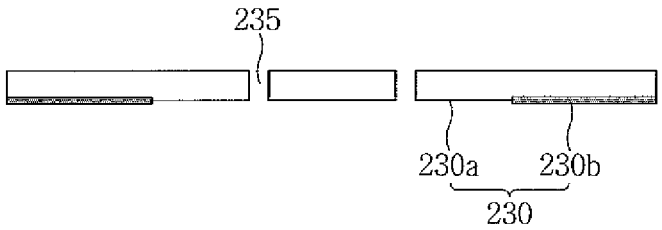

Referring to FIGS. 5A and 5B, a membrane 230 may include, for example, a hydrophilic area 230*a*, a hydrophobic area 230*b*, and a plurality of holes 235. The plurality of holes 235 may be formed, for example, in the hydrophilic area 230*a*. Referring back to FIGS. 2A to 2C, the plurality of holes 235 may be connected to the plurality of gas pipes 225, respectively.

Figure 6A:
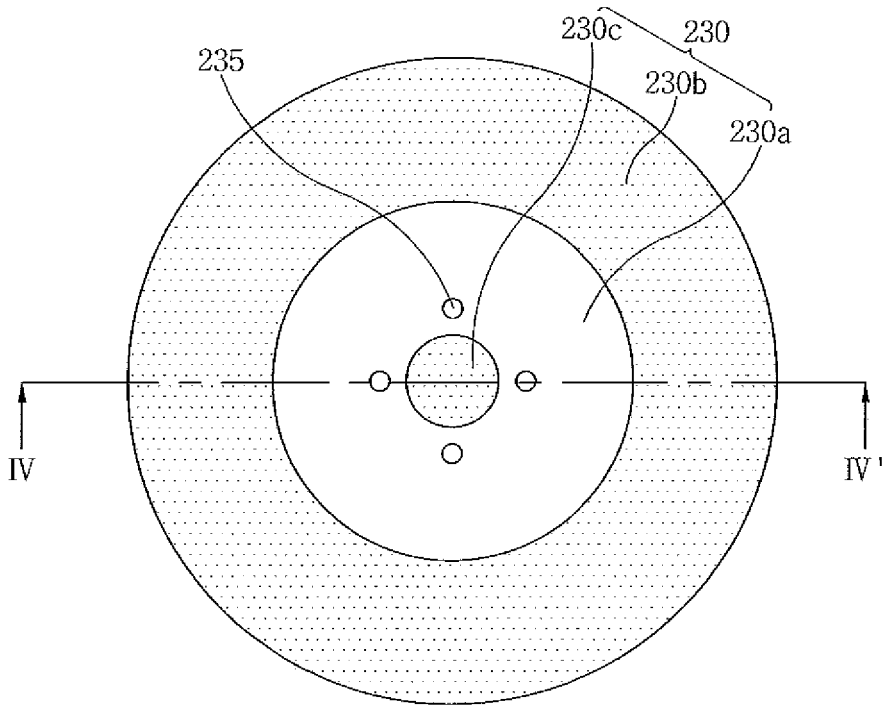
Figure 6B:
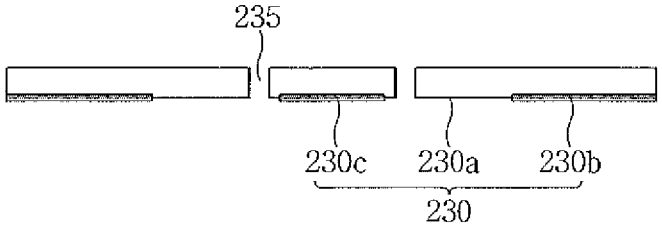

Referring to FIGS. 6A and 6B, a membrane 230 may include, for example, a hydrophilic area 230*a*, a hydrophobic area 230*b*, a center region 230*c*, and a plurality of holes 235. The plurality of holes 235 may be formed in, for example, the hydrophilic area 230*a*.

Figure 7A:
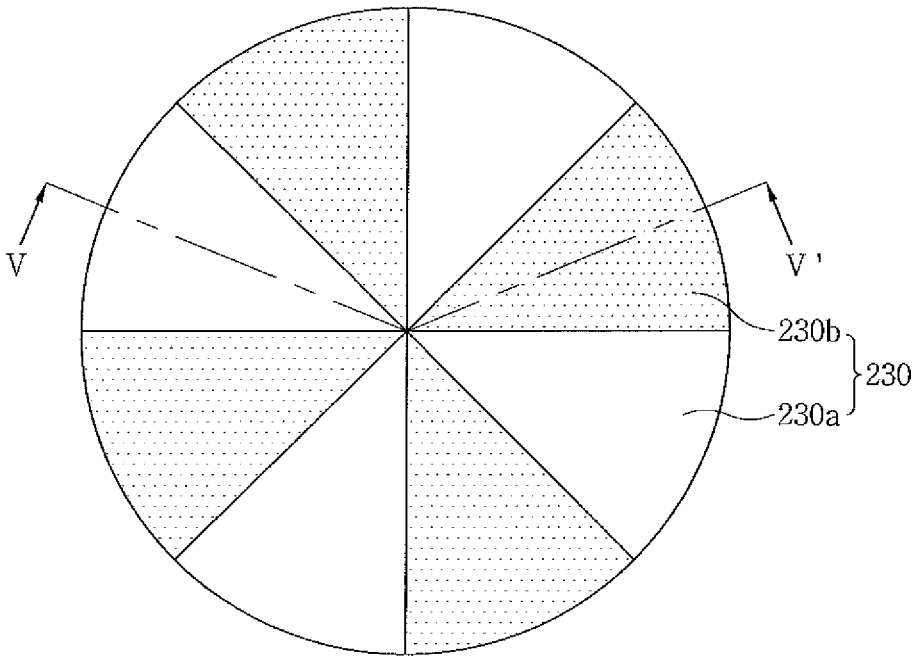
Figure 7B:
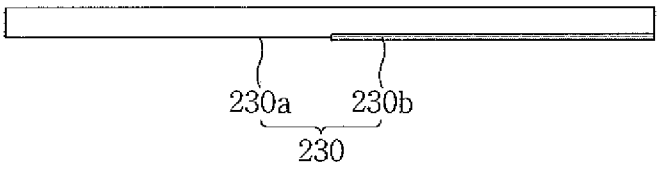

Referring to FIGS. 7A and 7B, a membrane 230 may include, for example, a plurality of hydrophilic areas 230*a* and a plurality of hydrophobic areas 230*b* that are arranged in a fan-like form.

Figure 8A:
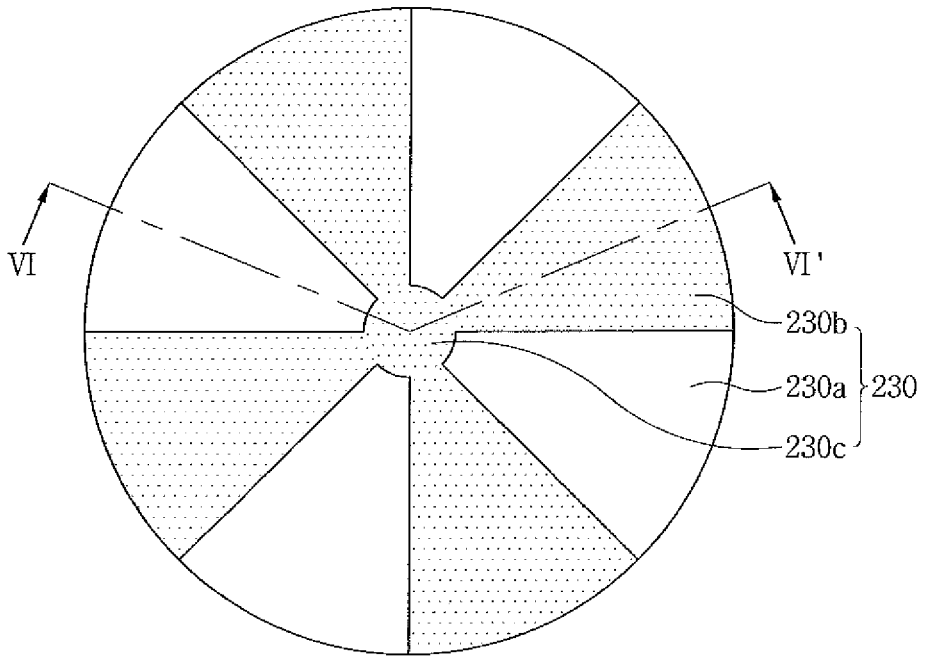
Figure 8B:
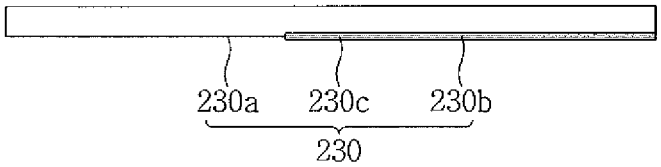

Referring to FIGS. 8A and 8B, a membrane 230 may include, for example, a plurality of hydrophilic areas 230*a* and a plurality of hydrophobic areas 230*b* that are arranged in a fan-like form, and a center region 230*c* located at a center of the plurality of hydrophilic areas 230*a* and the plurality of hydrophobic areas 230*b*. The center region 230C may be, for example, hydrophobic.

Figure 9A:
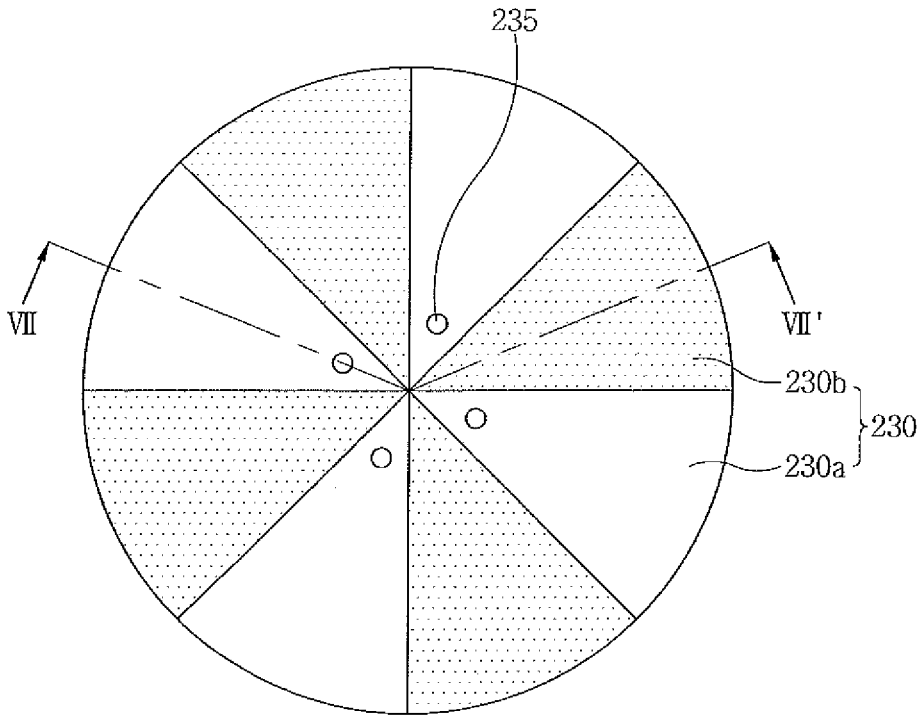
Figure 9B:
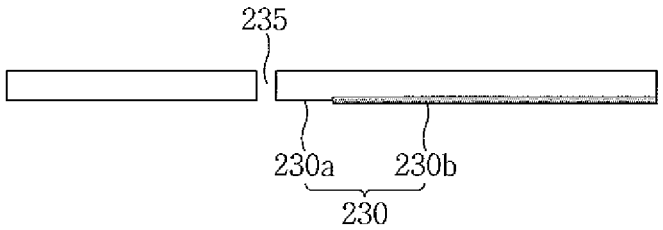

Referring to FIGS. 9A and 9B, a membrane 230 may include, for example, a plurality of hydrophilic areas 230*a* and a plurality of hydrophobic areas 230*b* that are arranged in a fan-like form, and a plurality of holes 235. The plurality of holes 235 may be formed in, for example, the hydrophilic areas 230*a*. Referring back to FIGS. 2A to 2C, the plurality of holes 235 may be connected to the plurality of gas pipes 225, respectively.

Figure 10A:
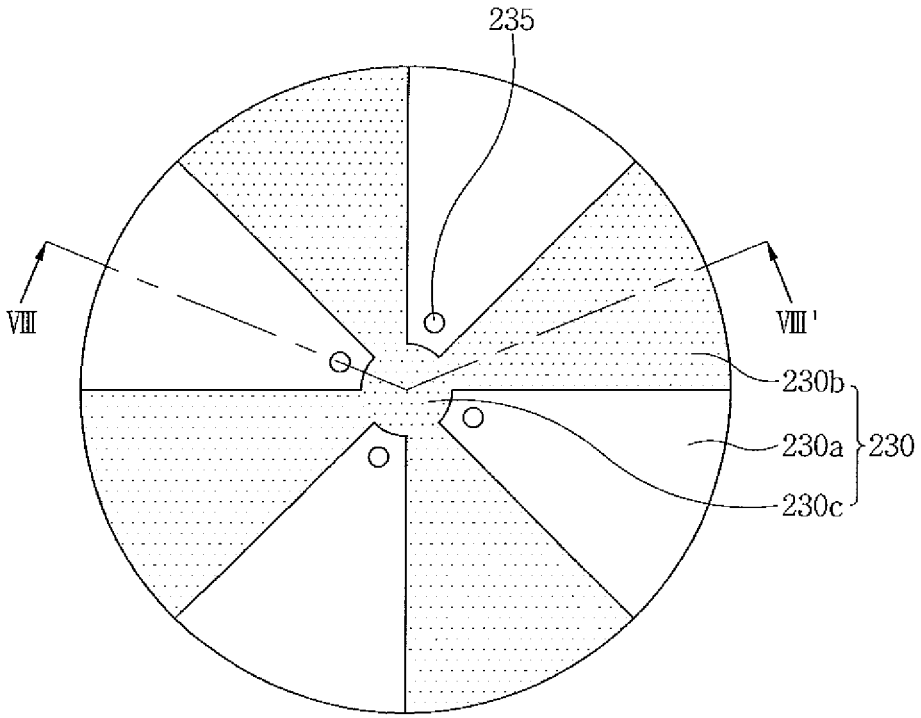
Figure 10B:
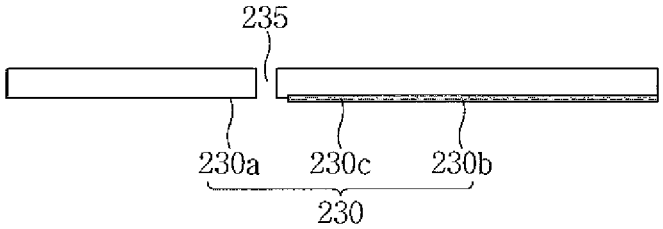

Referring to FIGS. 10A and 10B, a membrane 230 may include, for example, a plurality of hydrophilic areas 230*a* and a plurality of hydrophobic areas 230*b* that are arranged in a fan-like form, a center region 230*c* located at a center of the plurality of hydrophilic areas 230*a* and the plurality of hydrophobic areas 230*b*, and a plurality of holes 235. The plurality of holes 235 may be formed in, for example, the hydrophilic areas 230*a*. Referring back to FIGS. 2A to 2C, the plurality of holes 235 may be connected to the plurality of gas pipes 225, respectively.

These membranes 230 in accordance with embodiments of the inventive concept may include the hydrophilic area(s) 230*a*, the hydrophobic area(s) 230*b*, and/or the center region 230*c* that is hydrophobic, in various forms. Accordingly, the membrane 230 may have appropriate adsorbing and desorbing properties, and may be optimized.

FIGS. 11A to 11E are diagrams illustrating methods of loading/unloading the wafer W using the polishing head assembly 200 of the chemical mechanical polishing machine 10 in accordance with an embodiment of the inventive concept.

Figure 11A:
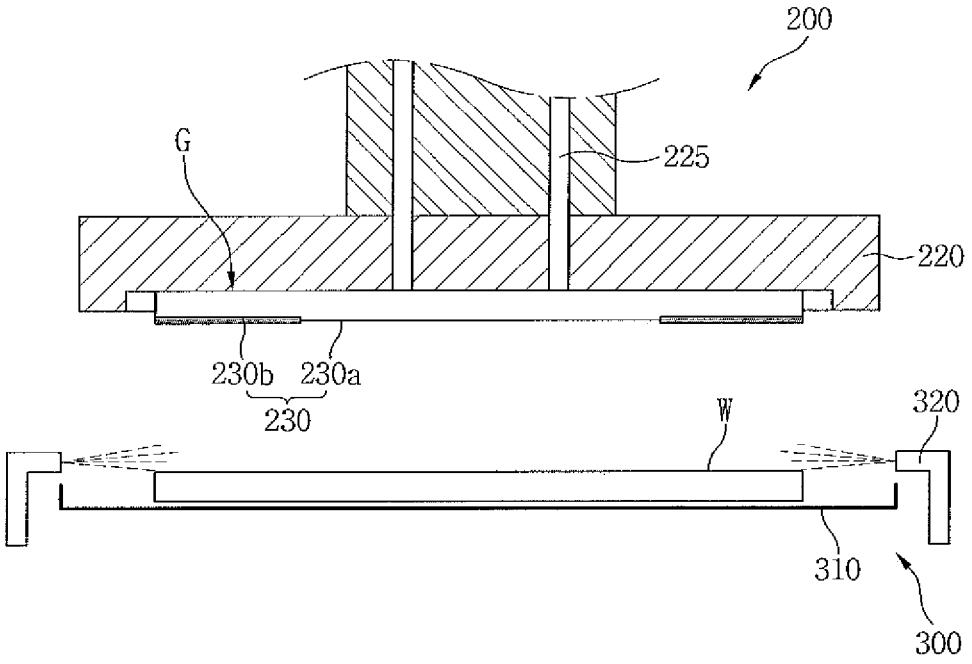
FIGS. 11A to 11E and 12A to 12C are diagrams schematically illustrating methods of loading/unloading a wafer using a polishing head assembly of a chemical mechanical polishing machine in accordance with an embodiment of the inventive concept.

Referring to FIG. 11A, the method of loading/unloading the wafer W may include, for example, spraying water onto the wafer W via a second nozzle 320 while the wafer W is placed on a support unit 310 of a wafer loader 300. A water film may be formed on the wafer W. The membrane 230 may include a hydrophilic area 230*a* and a hydrophobic area 230*b*.

Figure 11B:
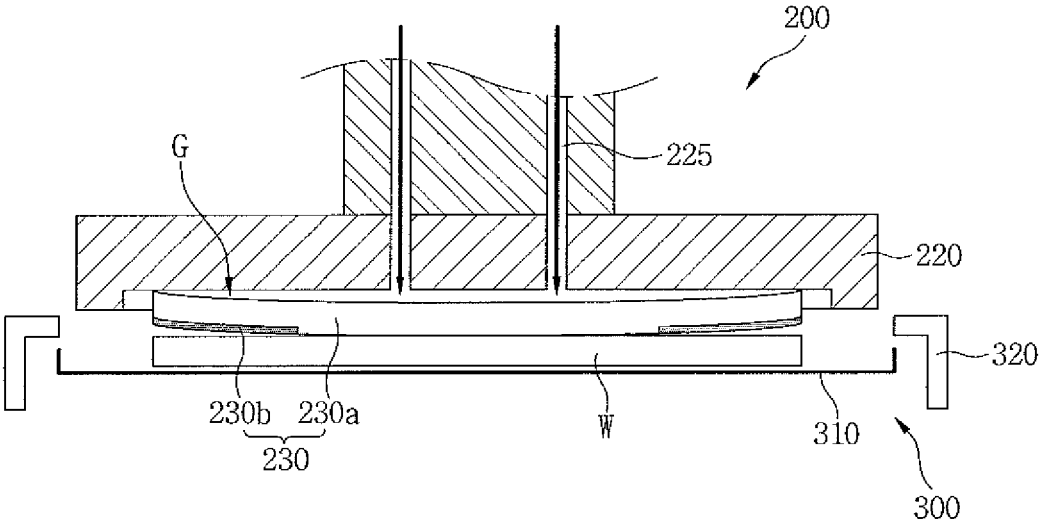

Referring to FIG. 11B, the method of loading/unloading the wafer W may include, for example, bringing the membrane 230 and the wafer W into contact with each other by moving the polishing head assembly 200 downward. At the same time, the method may further include, for example, injecting air between the membrane 230 and the groove G in the polishing head body 220 via the plurality of gas pipes 225. A central portion of the membrane 230 may, for example, protrude toward the wafer W.

Figure 11C:
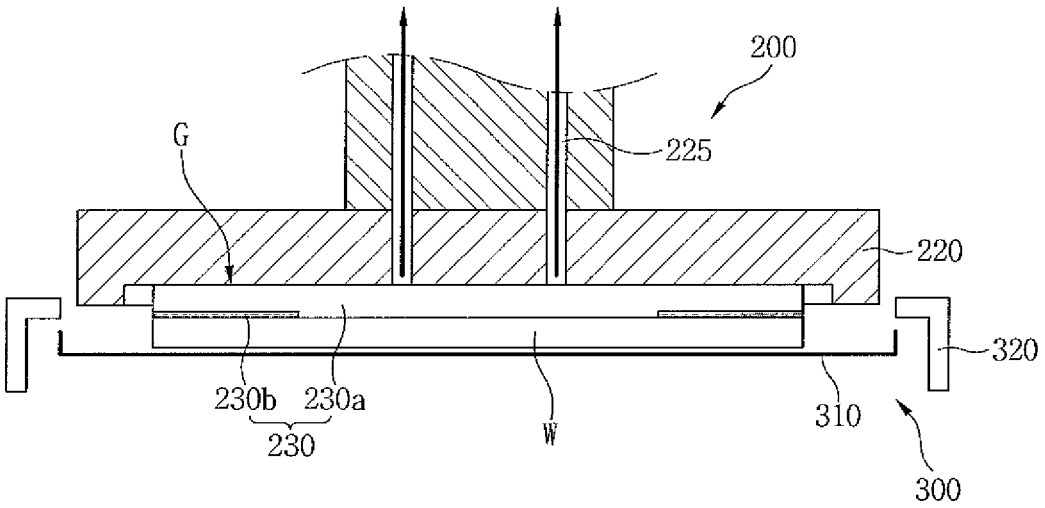

Referring to FIG. 11C, the method of loading/unloading the wafer W may include, for example, vacuum-adsorbing the membrane 230 by sucking air present between the membrane 230 and the groove G in the polishing head body 220 via the plurality of gas pipes 225. During this process, the wafer W may be adsorbed by the membrane 230 due to a capillary force of the membrane 230.

Figure 11D:
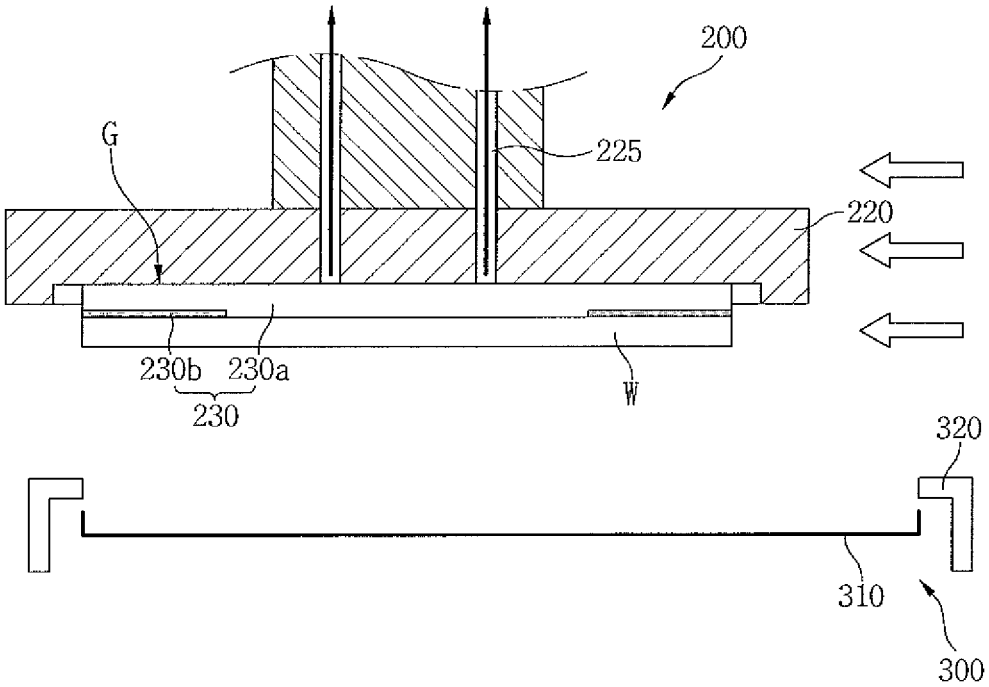

Referring to FIG. 11D, the method of loading/unloading the wafer W may include, for example, moving the polishing head assembly 200 upward to be disposed on the turntable 100 of FIG. 1. Air may be continuously sucked through the plurality of gas pipes 225 so that the membrane 230 may be vacuum-adsorbed by the polishing head body 220.

Figure 11E:
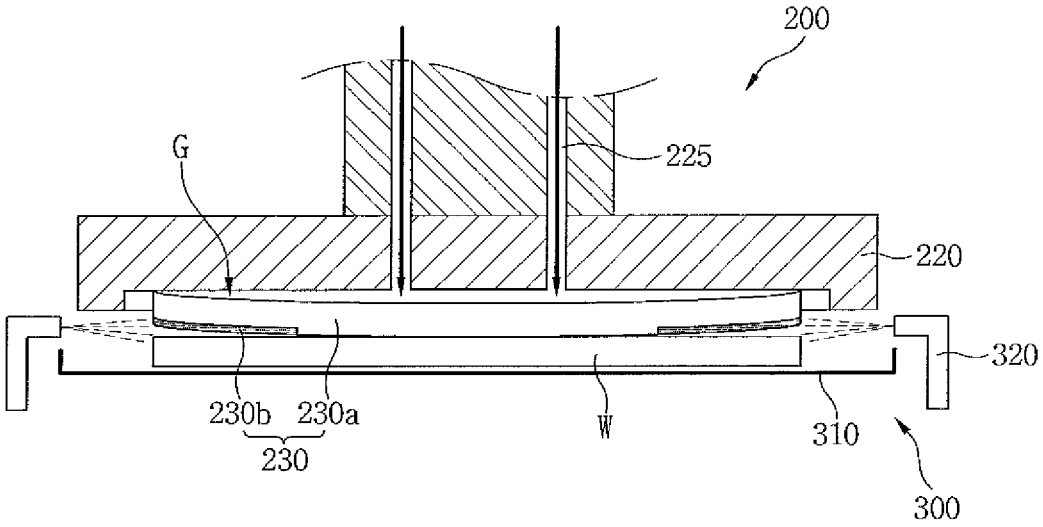

Referring to FIG. 11E, the method of loading/unloading the wafer W may include, for example, moving the polishing head assembly 200 to the wafer loader 300 and desorbing the wafer W, after a polishing process is completed. This method may further include, for example, injecting air between the membrane 230 and the groove G in the polishing head body 220 via the plurality of gas pipes 225. A central portion of the membrane 230 may, for example, protrude toward the wafer W. When the central portion of the membrane 230 protrudes, a contact region between the membrane 230 and the wafer W may decrease in size and a bonding force between the membrane 230 and the wafer W may be weakened. This method may further include, for example, injecting air or water between the wafer W and the membrane 230 via a second nozzle 320. As the hydrophobic area 230*b* is located at an edge, e.g., an outer portion, of the membrane 230, the membrane 230 and the wafer W may be relatively easily desorbed from each other.

Figure 12A:
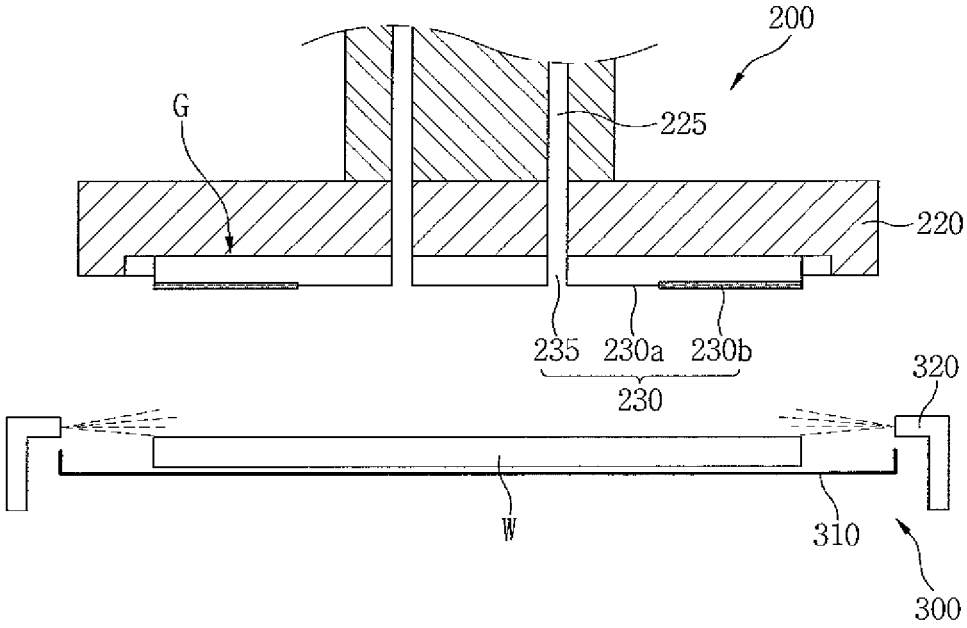
Figure 12B:
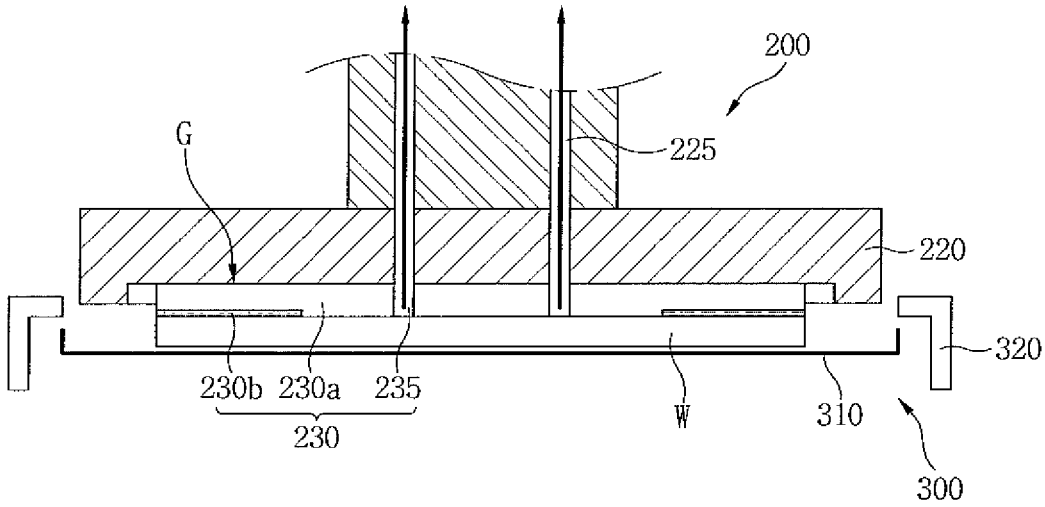
Figure 12C:
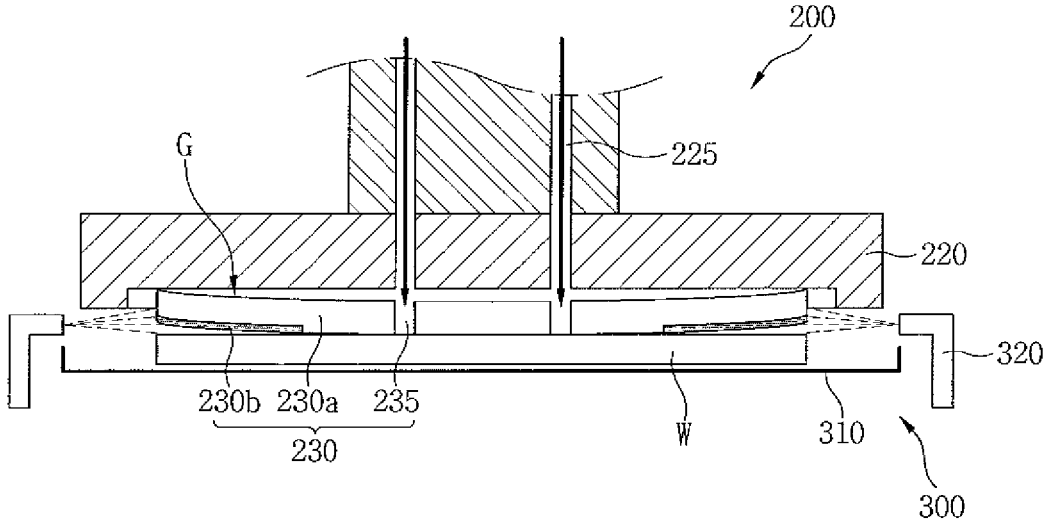

FIGS. 12A to 12C are diagrams illustrating methods of loading/unloading the wafer W using the polishing head assembly 200 of the chemical mechanical polishing machine 10 in accordance with an embodiment of the inventive concept.

Referring to FIG. 12A, the method of loading/unloading the wafer W may include, for example, spraying water onto the wafer W via a second nozzle 320 while the wafer W is placed on a support unit 310 of a wafer loader 300. The membrane 230 may include, for example, a hydrophilic area 230*a*, a hydrophobic area 230*b*, and holes 235.

Referring to FIG. 12B, the method of loading/unloading the wafer W may include, for example, moving the polishing head assembly 200 downward to cause a surface of the membrane 230 and a surface of the wafer W to be adhered to each other. At the same time, this method may further include, for example, sucking air between the membrane 230 and the wafer W via the plurality of gas pipes 225 and the holes 235 in the membrane 230. When the air between the membrane 230 and the wafer W is sucked toward the plurality of gas pipes 225 and the holes 235, the membrane 230 and the wafer W may contact each other having a water film therebetween. Thereafter, a process of polishing the wafer W may be performed while vacuum-pressure is maintained, as described above with reference to FIG. 11D.

Referring to FIG. 12C, the method of loading/unloading the wafer W may include, for example, moving the polishing head assembly 200 downward to desorb the wafer W from a surface of the membrane 230. This method may further include, for example, injecting air between the membrane 230 and the wafer W via the gas pipes 225 and the holes 235. A central portion of the membrane 230 may be bent downward due to a capillary force between the membrane 230 and the wafer W. The membrane 230 is formed of, for example, silicon having flexible properties and thus may be relatively easily bent. The wafer W is first desorbed from the hydrophobic area 230*b* of the membrane 230 that is more weakly adhered to the wafer W, when the membrane 230 is bent.

Also, as a force is converged on central portions of the membrane 230 and the wafer W due to self-load, a bonding force between the membrane 230 and the wafer W may be weakened to allow the wafer W to be stably unloaded from the membrane 230.

In a process of loading/unloading the wafer W using the polishing head assembly 200 including the membrane 230 in accordance with embodiments of the inventive concept, both appropriate adsorbing and desorbing properties may be achieved, and thus this process may be optimized. Accordingly, a process of polishing the wafer W and a process of desorbing the wafer W from the polishing head assembly 200 may be stabilized.

By using head membranes of chemical mechanical polishing machines in accordance with embodiments of the inventive concept, a capillary force between a head membrane of a chemical mechanical polishing machine and a wafer and a surface tension may be controlled during a chemical mechanical polishing process. Accordingly, the wafer may be prevented from slipping during the chemical mechanical polishing process, and may be prevented from being damaged when the wafer is separated from the head membrane of the chemical mechanical polishing machine after the chemical mechanical polishing process.

Having described exemplary embodiments of the inventive concept, it is further noted that it is readily apparent to those of ordinary skill in the art that various modifications may be made without departing from the spirit and scope of the invention which is defined by the metes and bounds of the appended claims.

What is claimed is:

1. A chemical mechanical polishing machine comprising:

a turntable having a substantially flat top surface and configured to rotate horizontally;

a polishing pad on the top surface of the turntable;

a polishing head assembly including a polishing head body and a membrane disposed at a bottom of the polishing head body, wherein the membrane is configured to be in contact with a back surface of a wafer, wherein a bottom surface of the membrane comprises a hydrophobic area and a hydrophilic area.

2. The chemical mechanical polishing machine of claim 1, wherein the membrane comprises a plurality of holes.

3. The chemical mechanical polishing machine of claim 2, wherein the plurality of holes are formed in the hydrophilic area.

4. The chemical mechanical polishing machine of claim 1, further comprising a wafer loader including a support unit which is configured to support the membrane thereon, wherein the wafer loader further comprises a nozzle configured to supply water between the membrane and the support unit.

5. The chemical mechanical polishing machine of claim 1, wherein the hydrophilic area is located on an inner portion of the bottom surface of the membrane, and the hydrophobic area is located on an outer portion of the bottom surface of the membrane.

6. The chemical mechanical polishing machine of claim 5, wherein the bottom surface of the membrane further comprises a center region disposed in the inner portion, wherein the center region is hydrophobic.

7. The chemical mechanical polishing machine of claim 6, wherein the bottom surface of the membrane has a circular shape having a first radius, and the hydrophilic area has a circular shape having a second radius, wherein the first radius is about 1.1 to about 10 times the second radius.

8. The chemical mechanical polishing machine of claim 1, wherein the membrane comprises silicon.

9. The chemical mechanical polishing machine of claim 1, wherein the hydrophobic area of the membrane comprises a hydrophobic polymer resin including one of a hydrocarbon radical (CH—) or a fluorocarbon radical (FC—).

10. The chemical mechanical polishing machine of claim 9, wherein the hydrocarbon radical (CH—) comprises one of an alkyl group or a phenyl group.

11. The chemical mechanical polishing machine of claim 9, wherein the hydrophobic polymer resin comprises one of dichloro-dimethylsilane (DDMS) or fluoro-octyl-trichlorosilane (FOTS).

12. The chemical mechanical polishing machine of claim 9, wherein the hydrophobic polymer resin is configured to form a covalent binding with the membrane.

13. The chemical mechanical polishing machine of claim 1, wherein the hydrophobic area has a thickness of about 1 to about 100 nm.

14. A polishing head assembly comprising:

a turntable having a substantially flat top surface and configured to rotate horizontally;

a polishing pad on the top surface of the turntable;

a polishing head body including a groove;

a membrane disposed in the groove and including a plurality of holes, wherein the membrane is configured to be in contact with a back surface of a wafer; and a fixing ring disposed between an external side surface of the membrane and an internal side surface of the groove, wherein a bottom surface of the membrane comprises a hydrophobic area and a hydrophilic area.

15. The polishing head assembly of claim 14, further comprising a plurality of gas pipes configured to be connected to the groove in the polishing head body, wherein the plurality of gas pipes and the plurality of holes are connected to one another.

16. The polishing head assembly of claim 14, further comprising a plurality of gas pipes configured to be connected to the groove in the polishing head body, and wherein the bottom surface of the membrane comprises a plurality of hydrophilic areas and a plurality of hydrophobic areas disposed in a fan-like form.

17. The polishing head assembly of claim 16, wherein the membrane further comprises a center region disposed at a center of the plurality of hydrophilic areas and the plurality of hydrophobic areas that are disposed in the fan-like form, and wherein the center region is hydrophobic.

18. The polishing head assembly of claim 16, wherein the membrane further comprises a plurality of holes disposed in the hydrophilic areas, and wherein the plurality of gas pipes and the plurality of holes are connected to one another.

19. The polishing head assembly of claim 16, wherein the membrane further comprises a center region disposed at a center of the plurality of hydrophilic areas and the plurality of hydrophobic areas that are disposed in the fan-like form and a plurality of holes disposed in the hydrophilic areas and wherein the plurality of gas pipes and the plurality of holes are connected to one another.

20. A chemical mechanical polishing machine, comprising:

a turntable having a substantially flat top surface and configured to rotate horizontally;

a polishing pad attached to and fixed on the top surface of the turntable;

a polishing head assembly configured to move a wafer disposed on a bottom surface thereof into contact with the polishing pad and polish the wafer;

a slurry supply device having at least one nozzle connected to an end portion thereof and configured to supply slurry on the polishing pad; and a conditioner having a diamond disk at an end portion thereof and configured to condition a surface of the polishing pad, wherein the polishing head assembly comprises:

a shaft configured to rotate as a central axis for polishing the wafer;

a polishing head body disposed at a bottom surface of the shaft, wherein the polishing head body includes a groove in a bottom surface thereof and a plurality of gas pipes passing through the polishing head body which are configured to be connected to the groove;

a membrane disposed in the groove, wherein the membrane is configured to be in contact with a back surface of a wafer, and wherein a bottom surface of the membrane comprises a hydrophobic area and a hydrophilic area; and a fixing ring having flexible properties and elastic properties and disposed between an external side surface of the membrane and an internal side surface of the groove in the polishing head body.

* * * * *